US010177470B2

(12) United States Patent
Bouchard

(10) Patent No.: US 10,177,470 B2
(45) Date of Patent: Jan. 8, 2019

(54) ELECTRICAL CONNECTION TERMINAL BETWEEN TWO CONDUCTIVE ELEMENTS

(71) Applicant: Schneider Electric Industries SAS, Rueil Malmaison (FR)

(72) Inventor: Jean-Luc Bouchard, Grenoble (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 15/797,134

(22) Filed: Oct. 30, 2017

(65) Prior Publication Data

US 2018/0166803 A1 Jun. 14, 2018

(30) Foreign Application Priority Data

Dec. 9, 2016 (FR) ..... 16 62232

(51) Int. Cl.
*H01R 9/24* (2006.01)
*H01R 4/44* (2006.01)
(Continued)

(52) U.S. Cl.
CPC ..... *H01R 9/2416* (2013.01); *H01R 4/38* (2013.01); *H01R 4/44* (2013.01); *H01R 9/2425* (2013.01); *H01R 4/48* (2013.01); *H01R 9/2633* (2013.01)

(58) Field of Classification Search
CPC ..... H01R 4/30; H01R 13/422; H01R 12/515; H01R 4/4836; H01R 9/2416; H01R 4/44; H01R 9/2425
(Continued)

(56) References Cited

U.S. PATENT DOCUMENTS 4,269,464 A 5/1981 Veldman
7,597,594 B2 * 10/2009 Stadler ..... H01R 4/30 439/733.1
(Continued)

FOREIGN PATENT DOCUMENTS

DE 195 13 281 A1 10/1996
EP 1 505 692 A1 2/2005
(Continued)

OTHER PUBLICATIONS

French Preliminary Search Report dated Aug. 4, 2017 in French Application 16 62232 filed on Dec. 9, 2016 (with English Translation of Categories of Cited Documents).

*Primary Examiner* — Edwin A. Leon
(74) *Attorney, Agent, or Firm* — Oblon, McClelland, Maier & Neustadt, L.L.P.

(57) ABSTRACT

An electrical connection terminal between two conductive elements includes at least one tightening screw, including a head and a thread, a stirrup, mounted around each screw, between the head and the thread of the screw, and a connector for each screw. Each connector includes a first stage, delimiting a tapping for receiving the tightening screw, and a second stage, arranged between the first stage and the stirrup and including a hole for passage of the screw, aligned with the tapping, the first stage being mobile relative to the second stage parallel to an axis of the screw. The terminal also includes a recess for receiving a first conductive element between the two stages of the connector, and a recess for receiving a second conductive element between the stirrup and the connector.

11 Claims, 5 Drawing Sheets

(51) Int. Cl.
*H01R 4/38* (2006.01)
*H01R 4/48* (2006.01)
*H01R 9/26* (2006.01)

(58) Field of Classification Search
USPC ..... 439/722
See application file for complete search history.

(56) References Cited

U.S. PATENT DOCUMENTS 7,625,253 B2 * 12/2009 Eppe ..... H01R 4/4836
439/835
7,780,460 B2 * 8/2010 Walter ..... H01R 4/363
439/81

FOREIGN PATENT DOCUMENTS

EP 1 796 214 A1 6/2007
EP 2 315 313 A1 4/2011

* cited by examiner

ELECTRICAL CONNECTION TERMINAL BETWEEN TWO CONDUCTIVE ELEMENTS

FIELD

The invention relates to an electrical connection terminal between two conducting elements.

The invention also relates to a connection module for an electrical contactor including a terminal of this type. Electrical contactors are used in motor starter sets to control industrial electric motors, such as asynchronous motors. An electrical set of this type typically comprises a contactor to interrupt selectively the supply of the electric charge in response to a control signal.

DESCRIPTION OF THE RELATED ART

The connection module includes a plurality of power conductors, in particular one conductor for each phase of the electric current. Each of the power conductors is intended to be connected, on the one hand, to a matching power conductor of the contactor and, on the other hand, to an external electrical cable. The connection between the power conductors and the electrical cables is established by means of the electrical connection terminal of the module.

The connection module is advantageously equipped with integrated measurement means, including, for example, a Rogowski sensor to measure the intensity of the electric current. These measurements are used in practice to guide an automatic control of the contactor. This type of sensor imposes a particular power conductor geometry, the shape of which is not suitable for implementing an electrical connection with a conventional clamping terminal of the type disclosed, in particular, in EP-A-0 148 056. In fact, there may be a significant cross-sectional difference between the power conductor and the electrical cable, so that it is difficult to position the cable in contact with the conductor during the clamping. The electrical connection is then not, or at least not very well, established.

As an alternative to clamping terminals, terminals known as lift cage terminals exist, as described, for example, in FR-A-2 740 265. In this document, the terminal includes a casing defining three chambers, each corresponding to an electric pole. Each of the chambers includes a connector for the electrical connection of the cables. Each connector includes a cage and a slide clamp, translationally movable, one towards the other, during the tightening of a screw. The slide is disposed inside the cage and a fixed conducting wall divides the cage into two. However this type of lift cage terminal cannot be used for reasons of compactness.

SUMMARY

The invention aims more particularly to overcome these disadvantages by proposing a compact electrical connection terminal providing a satisfactory electrical connection regardless of the geometry and cross section of the power conductor to be connected.

For this purpose, the invention relates to an electrical connection terminal between two conducting elements, this terminal including:

- at least one clamping screw, including a head and a thread,
- a clamp, mounted around each screw, between the head and the thread of the screw,
- a connector for each screw, each connector including a first level, delimiting a reception tapping for the clamping screw, and a second level, disposed between the first level and the clamp and including a passage hole for the screw, aligned with the tapping, the first level being movable in relation to the second level parallel to an axis of the screw,
- a reception housing for a first conducting element between the clamp and the connector, and
- a reception housing for a second conducting element between the two levels of the connector.

By means of the invention, the tightening of the screw causes the tightening of the first conducting element between the clamp and the connector and the tightening of the second conducting element between the two levels of the connector. The second conducting element is then pinched between the two levels of the connector, thereby establishing a reliable electrical connection between the connector and the second conducting element. The connector has a shape suitable for an electrical connection to a cable, in this case the first conducting element, so that the first conducting element and the second conducting element can be connected by means of a screw-clamp assembly.

According to advantageous but not obligatory aspects of the invention, an electrical connection terminal of this type may incorporate one or more of the following characteristics, taken in any technically admissible combination:

- The two levels of the connector are contiguous.
- The connector is C-shaped, wherein the first level and the second level of the connector form two parallel arms of the C.
- The terminal includes a reception seat for the connector, this seat being configured to prevent the movement of the first level of the connector in an axial direction opposite to the second level.
- Each clamp includes two wings, wherein two housings are provided, each to receive a respective second conducting element, each housing being defined between the connector and one wing of the clamp.

The invention also relates to a connection module for an electrical contactor, this module including a connection terminal as previously described.

- The module includes integrated measurement means to measure one or more electrical parameters, such as the voltage or intensity of the electric current.
- The module includes the first conducting element or each of the first conducting elements.
- The first conducting element or each of the first conducting elements delimits a recess or a hole for the passage of the clamping screw.

The invention finally relates to a set including an electrical contactor and a connection module as previously described.

BRIEF DESCRIPTION OF THE DRAWINGS

The invention and its other advantages will become clearer in the light of the description that follows of an embodiment of an electrical connection terminal according to its principle, given only by way of example and described with reference to the attached drawings, in which.

DETAILED DESCRIPTION

Figure 1:
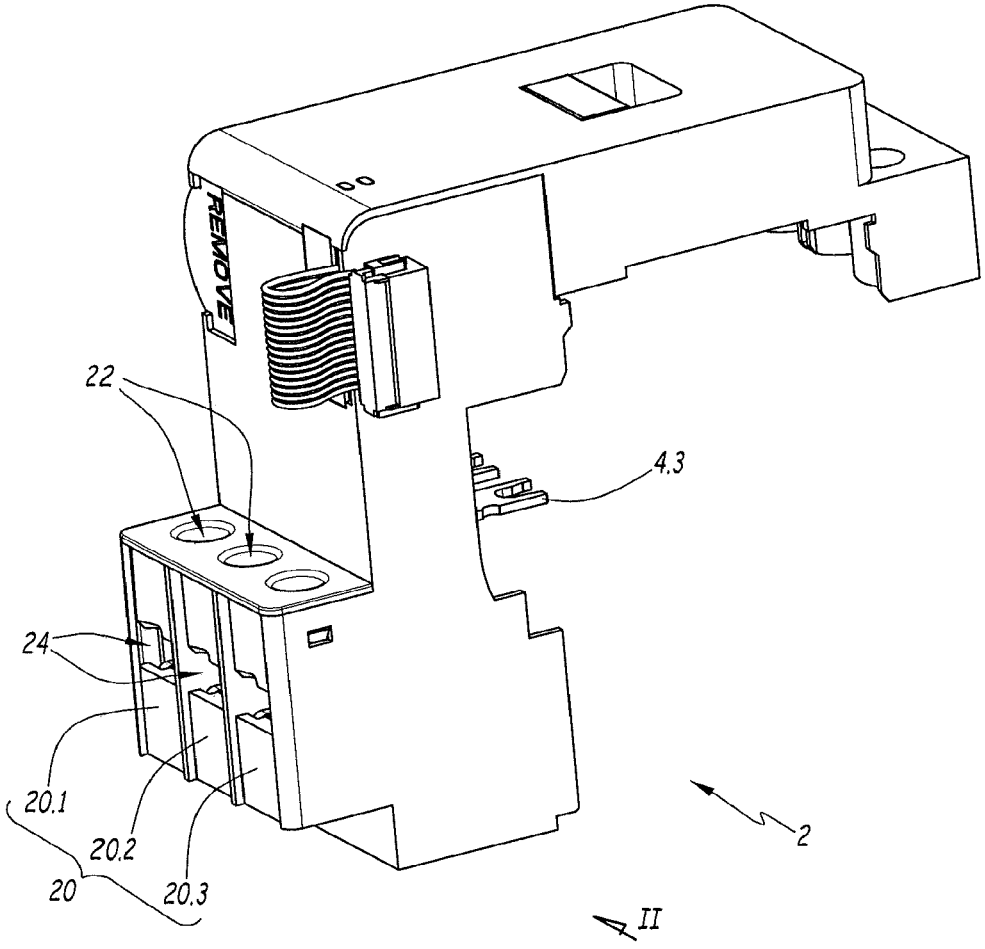
FIG. 1 is a perspective view of a module including an electrical connection terminal according to the invention.
Figure 2:
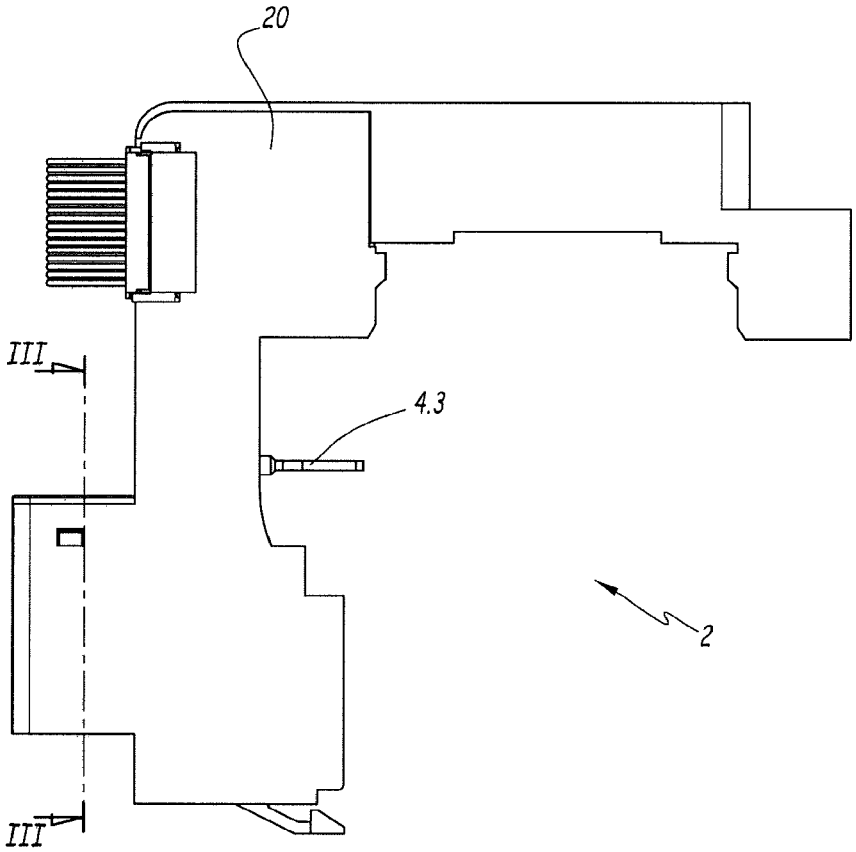
FIG. 2 is a view according to the arrow II in FIG. 1.

FIG. 1 shows a connection module 2 for an electrical contactor (not shown). The connection module 2 appears in the form of a housing which has been placed on the contactor. In the example, the connection module 2 includes three first conducting elements, in particular three power conductors 4.1, 4.2 and 4.3, each dedicated to a phase of the electric current (positive, negative and neutral).

The module 2 advantageously includes integrated measurement means (not shown) to measure one or more electrical parameters, such as the voltage or intensity of the electric current. In the example, these means include a Rogowski sensor. The measurements are used in practice to guide an automatic control of the contactor (not shown).

Figure 5:
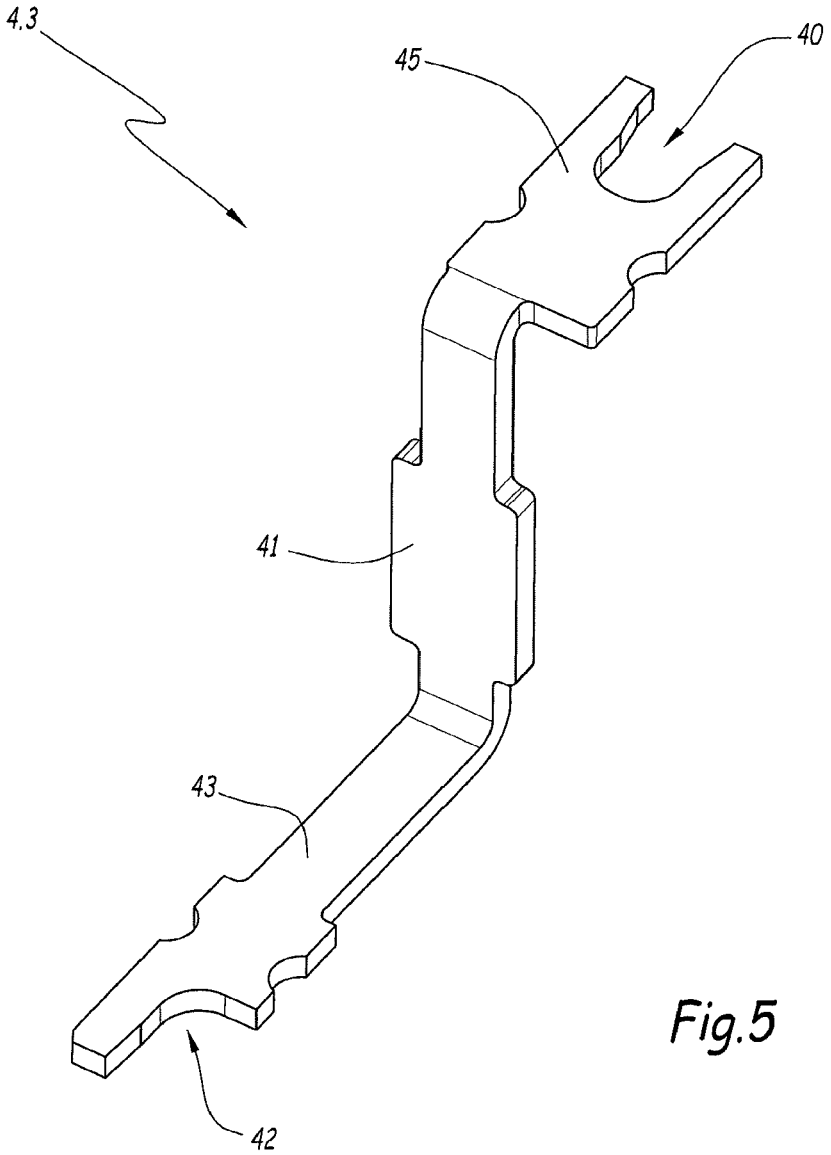
FIG. 5 is a perspective view of a conducting element belonging to the module.

The conductor 4.3 is shown alone in FIG. 5. Each of the power conductors 4.1 to 4.3 includes a central part 41 and two arms 43 and 45 which extend perpendicular to the central part 41 in opposite directions. The arm 45 includes a forked free end 40 which is intended to be connected to a conducting part of the contactor (not shown).

The connection model 2 includes an electrical connection terminal 20 to connect each of the first conducting elements 4.1, 4.2 and 4.3 respectively to a second conducting element 12.1, 12.2 or 12.3. In the example, each of the second conducting elements 12.1, 12.2 and 12.3 is a cable with a circular cross section.

The connection terminal 20 includes three compartments, 20.1, 20.2 and 20.3 respectively. Each of the compartments 20.1, 20.2 and 20.3 of the electrical connection terminal 20 includes a clamping screw 6, a clamp 8 and a connector 10.

Figure 4:
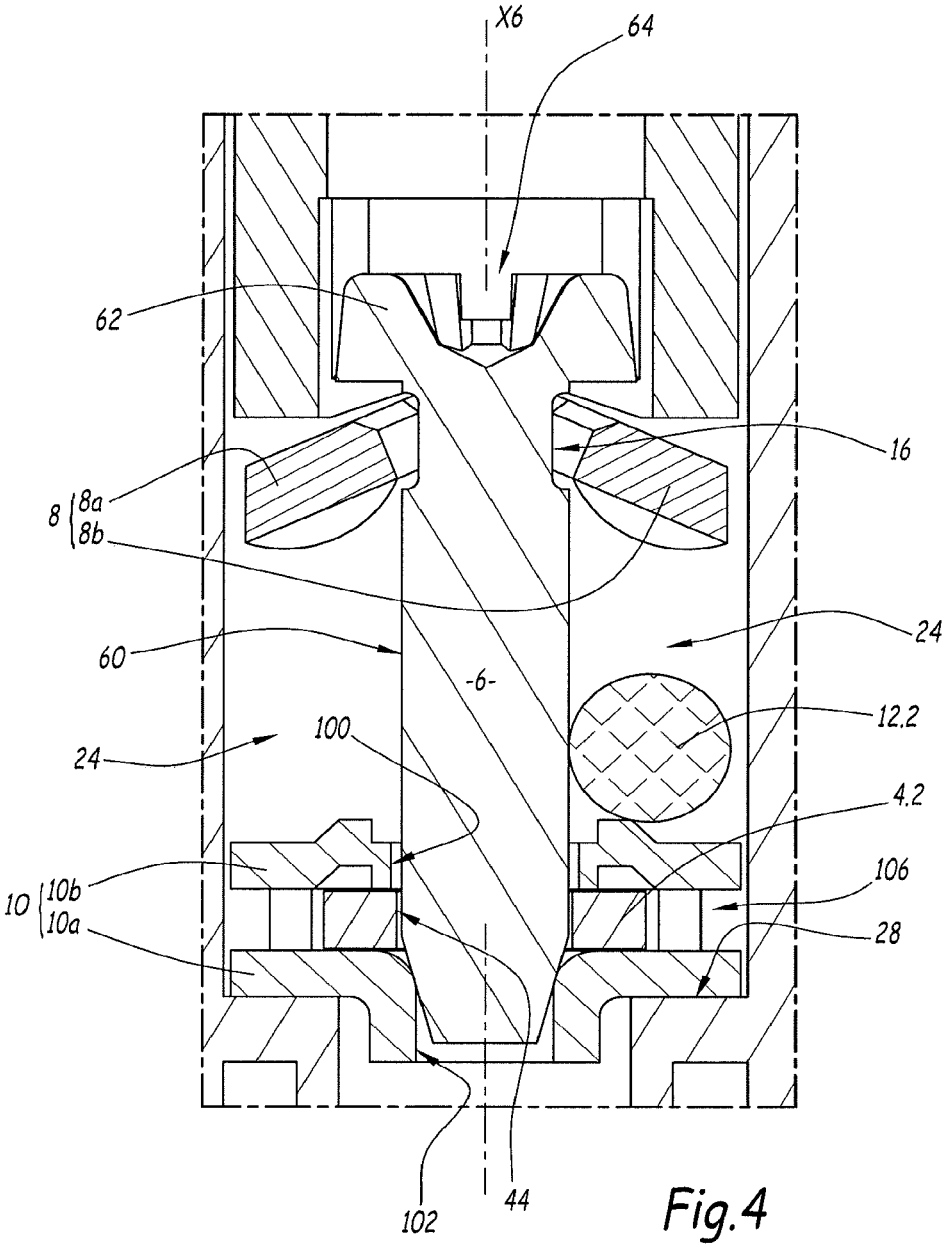
FIG. 4 is a larger-scale view of the frame IV in FIG. 3.

As shown in FIG. 4, the clamping screw 6 defines a central axis X6. It includes a threaded part 60, a screw head 62 and an aperture 64 provided for the passage of a spanner or screwdriver (not shown). The screw 6 also includes a part 66 having a narrowing cross section, disposed between the head 62 and the thread 60.

The clamp 8 is mounted around the screw 6, particularly in the area of the part 66, and includes two wings 8*a* and 8*b* which extend on either side of the screw 6 in a direction which is inclined in relation to the axis X6 of the screw 6. The clamp 8 is translationally fixed along the screw 6. Conversely, it is mounted with a radial clearance around the screw 6, in such a way as to be able to tilt on one side or the other. This advantageously allows cables having different cross sections to be clamped on either side of the screw 6 without the cable which has a smaller cross section being less tightly clamped.

The connector 10 is made from an electrically conducting material. It is disposed at one end of the screw 6 opposite the screw head 62. It includes a first level 10*a*, delimiting a reception tapping 102 for the clamping screw 6. The tapping 102 is centred on an axis combined with the axis X6 and has a screw thread matching that of the tapping 60 of the screw. The connector 10 also includes a second level 10*b* which is disposed between the first level 10*a* and the clamp 8. The second level 10*b* includes a passage hole 100 for the screw 6 which is aligned with the thread 102 following the axis X6. The hole 100 has a wider diameter than that of the screw 6. The first level 10*a* is movable in relation to the second level 10*b* in a direction parallel to the axis of the screw X6 under the effect of the tightening of the screw 6.

The two levels 10*a* and 10*b* of the connector 10 are advantageously parallel and perpendicular to the axis of the screw X6.

The clamp 8 and the second level 10*b* of the connector 10 define between them at least one, preferably two, housings 24, each configured for a first conducting element, from the cables 12.1, 12.2 and 12.3. The housings 24 are defined respectively between the wings 8*a* and 8*b* of the clamp and the second level 10*b* of the connector 10. In the example, only one of the two housings receives a cable. However, even if this configuration is not shown in the figures, each compartment of the terminal 20 allows a minimum of two cables to be connected, on either side of the screw 6, with the corresponding first conducting element, from the elements 4.1, 4.2 and 4.3.

As shown in FIG. 4, the two levels 10*a* and 10*b* of the connector 10 define between them a reception housing 106 for a second conducting element, from the power conductors 4.1, 4.2 and 4.3. More precisely, the housing 106 is configured to receive the free end of the arm 43 of the corresponding power conductor.

The two levels 10*a* and 10*b* of the connector 10 are advantageously contiguous. In particular, the connector 10 is C-shaped, the two levels 10*a* and 10*b* of the connector 10 then forming the parallel arms of the C.

In the example, the connection terminal 20 includes a seat 28 on which the connector 10 rests. This seat 28 is configured to prevent the movement of the first level 10*a* in an axial direction opposite to the second level 10*b* during the tightening of the screw 6.

Figure 3:
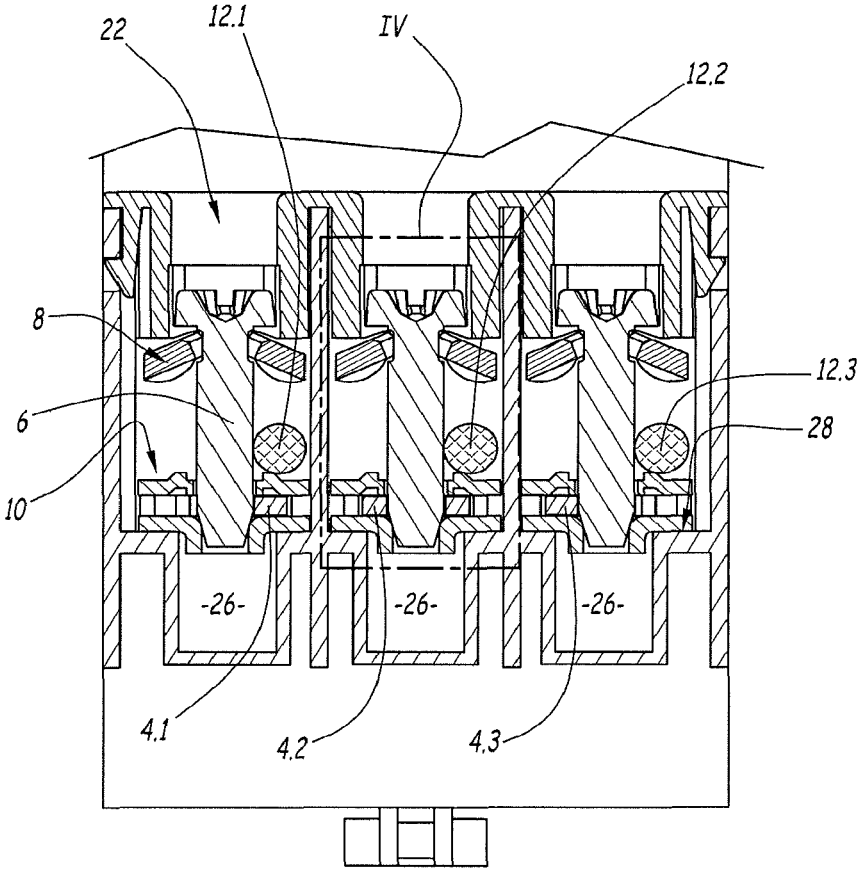
FIG. 3 is a section in the plane of the line III-III in FIG. 2.

As shown in FIG. 3, the connection terminal 20 also includes, for each compartment, a hole 22 for the passage of a spanner or screwdriver and a reinforcement 26 which is disposed below the connector 10 on the opposite side to the clamp 8 and which is provided to receive the screw 6 during the tightening.

In each compartment, the screw 6 passes through the conducting element 4.1, 4.2 and 4.3. Thus, as shown in FIG. 4, the conducting element 4.2 includes a passage hole 44 for the screw 6 and, as shown in FIGS. 3 and 5, the elements 4.1 and 4.2 include a recess 42 for the passage of the screw. This recess is provided at the free end of the arm 43.

In order to establish an electrical connection between two conducting elements, for example between the conducting elements 12.2 and 4.2, it is expedient to position the conducting element 12.2 between the clamp 8 and the connector 10 on one side or the other of the screw 6, then to tighten the screw 6. The tightening of the screw 6 causes the movement of the first level 10*a* of the connector 10 towards the second level 10*b*. The level 10*a* detaches from the seat 28 and the conducting element 4.2 is pinched between the two levels 10*a* and 10*b* of the connector 10, thereby providing a reliable electrical connection between the conductor 4.2 and the connector 10. In parallel, the clamp 8 moves axially towards the connector 10, thereby clamping the conducting element 12.2 between the clamp 8 and the connector 10.

When the screw 6 is loosened, for example to remove the cable, the first level 10*a* abuts against the seat 28 and the screw 6 slides across the level 10*a*.

In one variant (not shown), the electrical connection terminal 20 is completely independent, i.e. does not form an integral part of a connection module for a contactor.

According to a different variant (not shown), the connection terminal 20 includes a number of compartments other than three. In particular, the connection terminal 20 may include a single compartment or only two compartments.

According to a different variant (not shown), the housing 106 of each connector 10 may be configured to receive a plurality of conducting elements.

According to a different variant (not shown), the levels 10*a* and 10*b* of the connector 10 are separate. The level 10*b* is then translationally immobilised according to the axis X6, for example fixed to the terminal 20.

The characteristics of the embodiment and the different variants envisaged above can be combined with one another in order to generate new embodiments of the invention.

The invention claimed is:

1. An electrical connection terminal between two conducting elements, the terminal comprising:

at least one clamping screw, including a head and a thread;

a clamp, mounted around each screw, between the head and the thread of the screw, the clamp including at least two wings;

a connector for each screw, each connector including a first level, delimiting a reception tapping for the clamping screw, and a second level, disposed between the first level and the clamp and including a passage hole for the screw, aligned with the tapping, the first level being movable in relation to the second level parallel to an axis of the screw;

a reception housing for a first conducting element between the two levels of the connector; and a reception housing for a second conducting element between the clamp and the connector.

2. The terminal according to claim 1, in which the two levels of the connector are contiguous.

3. The terminal according to claim 1, in which the connector is C-shaped, wherein the first level and the second level of the connector form two parallel arms of the C.

4. The terminal according to claim 1, further comprising:

a reception seat for the connector, said seat being configured to prevent the movement of the first level of the connector in an axial direction opposite to the second level.

5. The terminal according to claim 1, wherein two housings are provided, each to receive a respective second conducting element, each housing being defined between the connector and one of the at least two wings of the clamp.

6. A connection module for an electrical contactor, the module comprising:

the connection terminal according to claim 1.

7. The module according to claim 6, further comprising:

integrated measurement means to measure one or more electrical parameters.

8. The module according to claim 6, further comprising:

the first conducting element or each of the first conducting elements.

9. The module according to claim 8, in which the first conducting element or each of the first conducting elements delimits a recess or a hole for the passage of the clamping screw.

10. A set comprising:

an electrical contactor and the connection module according to claim 6.

11. The module according to claim 7, in which the one or more electrical parameters include a voltage or intensity of the electric current.

* * * * *